US009523254B1

(12) United States Patent
Barton et al.

(10) Patent No.: US 9,523,254 B1
(45) Date of Patent: Dec. 20, 2016

(54) CAPILLARY PUMP DOWN TOOL

(71) Applicant: SageRider, Incorporated, a Texas corporation, Rosharon, TX (US)

(72) Inventors: Ryan Barton, Richmond, TX (US); Tyler Wall, Richmond, TX (US); William Shroyer, Katy, TX (US); Steven Lee Jackson, Eureka Springs, AR (US)

(73) Assignee: SageRider, Incorporated, Stafford, TX (US)

( * ) Notice: Subject to any disclaimer, the term of this patent is extended or adjusted under 35 U.S.C. 154(b) by 385 days.

(21) Appl. No.: 13/670,283

(22) Filed: Nov. 6, 2012

(51) Int. Cl.
*E21B 23/08* (2006.01)
*E21B 47/00* (2012.01)
*E21B 41/00* (2006.01)

(52) U.S. Cl.
CPC ..... *E21B 23/08* (2013.01); *E21B 41/0035* (2013.01); *E21B 47/00* (2013.01)

(58) Field of Classification Search
CPC ..... E21B 23/08; E21B 23/10; E21B 23/14; E21B 47/01; E21B 47/00; E21B 41/0035
USPC ..... 166/64
See application file for complete search history.

(56) References Cited

U.S. PATENT DOCUMENTS

| | | | | |
|---|---|---|---|---|
| 4,484,628 | A * | 11/1984 | Lanmon, II | 166/254.2 |
| 5,568,837 | A * | 10/1996 | Funk | 166/383 |
| 5,862,866 | A * | 1/1999 | Springer | 166/380 |
| 5,871,052 | A * | 2/1999 | Benson et al. | 166/386 |
| 6,138,764 | A * | 10/2000 | Scarsdale | E21B 23/08 166/117.6 |
| 6,281,489 | B1 | 8/2001 | Tubel et al. | |
| 6,532,839 | B1 | 3/2003 | Kluth et al. | |
| 6,557,630 | B2 | 5/2003 | Harkins et al. | |
| 6,923,273 | B2 | 8/2005 | Terry et al. | |
| 6,943,340 | B2 | 9/2005 | Tubel et al. | |
| 6,955,218 | B2 | 10/2005 | Coon et al. | |
| 7,040,390 | B2 | 5/2006 | Tubel et al. | |
| 7,140,435 | B2 | 11/2006 | Defretin et al. | |
| 7,213,657 | B2 | 5/2007 | Vold et al. | |
| 7,322,421 | B2 | 1/2008 | Blacklaw | |
| 2002/0117300 | A1 * | 8/2002 | Spencer | E21B 23/08 166/254.2 |

(Continued)

FOREIGN PATENT DOCUMENTS

| | | |
|---|---|---|
| EP | 0910725 B1 | 7/2003 |
| EP | 1203942 B1 | 9/2007 |

(Continued)

OTHER PUBLICATIONS

Perry Joseph Wright, "The Future of Fiber Optics in the Offshore Oil Industry," Offshore Magazine, May 2000.

(Continued)

*Primary Examiner* — Robert E Fuller
*Assistant Examiner* — Christopher Sebesta
(74) *Attorney, Agent, or Firm* — McAfee & Taft A Professional Corporation

(57) ABSTRACT

A capillary delivery system includes a capillary pump down tool. The capillary pump down tool is pumped into a well until it engages a landing sub that is positioned in a lateral section of the well. The capillary may be a fiber optic cable secured to the pump down tool. When the pump down tool reaches a desired location in the well the fiber optic cable and/or sensors in the pump down tool will sense parameters in the well.

18 Claims, 5 Drawing Sheets

(56) References Cited

U.S. PATENT DOCUMENTS

| | | | | |
|---|---|---|---|---|
| 2004/0065444 | A1* | 4/2004 | Smith et al. | 166/381 |
| 2008/0066961 | A1* | 3/2008 | Aivalis et al. | 175/50 |
| 2008/0272931 | A1* | 11/2008 | Auzerais et al. | 340/854.7 |
| 2008/0317095 | A1* | 12/2008 | Hadley et al. | 374/137 |
| 2010/0132955 | A1* | 6/2010 | Storm, Jr. | E21B 23/02 166/377 |
| 2013/0025852 | A1* | 1/2013 | Edmonstone | E21B 23/10 166/250.01 |

FOREIGN PATENT DOCUMENTS

| | | | |
|---|---|---|---|
| GB | 2397648 | A | 7/2004 |
| WO | 2005/116388 | A1 | 12/2005 |

OTHER PUBLICATIONS

E. J. Zisk, "Downhole Fiber Optic Distributed Temperature Sensing System," Weatherford Completion Systems Manual, Sep. 23, 2002.

Neal G. Skinner, et al., "Downhole Fiber-optic Sensing: The Oilfield Service Provider's Perspective," Proc of SPIE vol. 5589, pp. 206-220.

Risi Jadesole Omotosho, "Permanent Downhole Sensors in Today's Petroleum Industry," Report presented to the Faculty of the Graduate School of the University of Texas at Austin in Partial Fulfillment of the Requirements for the Degree of Master of Science in Engineering, Aug. 2004.

Jorge Duarte Olarte, et al., "Fiber-optic coiled tubing logging improves reliability of water shut-off," Article located at http://www.worldoil.com/March-2012, Sep. 18, 2012.

* cited by examiner

CAPILLARY PUMP DOWN TOOL

BACKGROUND OF THE INVENTION

There are a number of techniques used for measuring and monitoring parameters in a well bore and for delivering the sensed or measured parameters to the surface. Fiber optic cable and fiber optic sensors are often used in well bores to sense parameters and to deliver the magnitude of the sensed parameters to the surface. The parameters are utilized for a variety of reasons including but not limited to determining where hydrocarbons might exist in a formation or zone intersected by the well bore. Fiber optic cable and/or sensors are delivered into well bores in a number of ways. For example, fiber optic cable will often be strapped to or connected in another way to tubing that is lowered into a well. While this works well in many instances, it is desirable to be able to deliver fiber optic cable and sensors into the well and in particular to the horizontal portion of a well in other manners. The current disclosure is directed to an apparatus and method for delivering fiber optic cable and/or sensors into a well and more particularly into a horizontal portion of a well bore.

SUMMARY

The current disclosure is directed to a capillary delivery system which includes a capillary tube pump down assembly. The disclosure describes the capillary tube pump down system for use in a cased well but it is understood that the system may be used with an uncased well. The capillary delivery system includes a capillary tube pump down assembly which may include a pump down tool and a landing sub. The capillary tube delivery system disclosed herein is described with respect to fiber optic cable but it is understood that other capillary tubes may be delivered using the system described.

The landing sub of the capillary tube pump down assembly is lowered into a well using a tubing which may be coiled or jointed tubing. The landing sub is lowered through a vertical section of the well and into a lateral section. After the landing sub is properly positioned in the lateral section of the well, the pump down tool is injected into the well with an injector head and is pumped through the vertical section of the well into the lateral section thereof until the pump down tool engages and lands in the landing sub. Prior to pumping the pump down tool into the well a capillary, for example, a fiber optic cable, is connected thereto. The fiber optic cable is fixed to the pump down tool such that as the pump down tool is pumped through the vertical section into the lateral section of the well the fiber optic cable will be pulled through the well to a desired location in the lateral section of the well. The pump down tool may include at least one and preferably a plurality of gauges or sensors such that when the pump down tool engages the landing sub measurements of certain well parameters may be taken in the well. For example, the gauges may measure temperature of fluid in the well. The measured temperatures can be sent to the surface and evaluated to determine where hydrocarbons exist. The information can be used to determine if a well treatment, such as fracturing or perforating should occur, and from where production hydrocarbons may be obtained. The fiber optic cable itself may be also used to sense parameters such as temperature in the well.

The method of utilizing the capillary delivery system may comprise lowering a landing sub in the well with tubing to a preselected location. Once the landing sub is lowered into the well the pump down tool can be injected into the tubing and pumped therethrough to pull the fiber optic cable into the lateral section of the well. A capillary injector may be utilized to prevent over tensioning on the cable as the pump down tool pulls the cable through the well. Once the pump down tool has landed the method may further comprise sensing selected parameters in the well and sending signals representative of the parameters to the surface. The sensed parameters, such as temperature, may be evaluated and determinations made regarding further well treatment and production. Once the necessary parameters have been sensed in the well, a wireline may be utilized to retrieve the pump down tool from the well and production and/or treatment can occur through the tubing that was installed to lower the landing sub.

DESCRIPTION OF AN EMBODIMENT

It is often necessary, or desirable, to sense or measure parameters in a well and to use the information for a variety of purposes including but not limited to analyzing, facilitating and increasing production from the well. For example, certain temperatures and temperature differences at spaced locations in a well can assist in identifying where hydrocarbons are located and thus from where production may be obtained may be produced.

The capillary delivery system of the current disclosure provides an apparatus and method by which a capillary tube, such as for example a fiber optic cable, may be delivered into a lateral section of a well bore and may be accurately positioned therein so that well parameters, such as for example pressure and temperature may be sensed and the sensed parameters delivered back to the surface to be analyzed and used in well treatment and/or production decisions.

Figure 1:
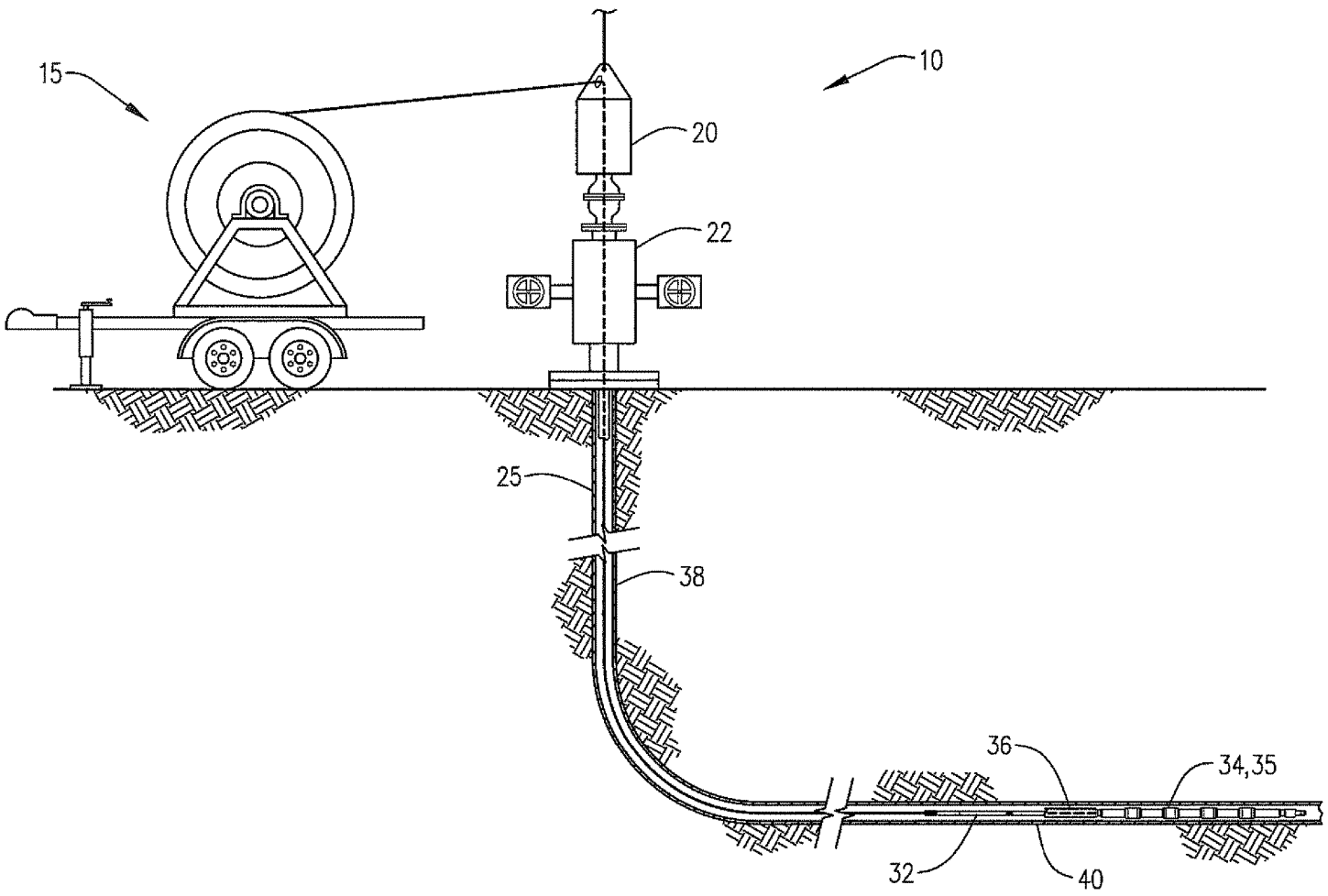
FIG. 1 is a schematic of a capillary delivery system.

Turning to the figures, and more particularly to FIG. 1, a capillary delivery system 10, which in the embodiment described is a fiber optic cable delivery system 10, may include a spooling unit 15 and an injector head 20. Spooling unit 15 and injector head 20 may be of a type known in the art and may include line counters and other gauges and devices to determine the length of fiber cable rolled off of spool 15 and to determine the amount of tension placed on the fiber optic cable. The fiber optic cable will pass through well head 22 into well 25. In the embodiment described well 25 is a cased well, but delivery system 10 may also be used in an uncased well. Capillary delivery system 10 described herein may be used to deliver fiber optic cable, or other capillary tubes into the lateral section of a producing well 25.

Delivery system 10 includes a pump down tool 32 and a landing sub 34. Landing sub 34 defines a seat, or landing profile 43. Pump down tool 32 and landing sub 34 may be referred to collectively as pump down assembly 35. Landing sub 34 is lowered into well 25 on a tubing 36, which may be jointed or coiled tubing. Tubing 36 has a passageway 37 defined by inner diameter 39.

Landing sub 34 is lowered into well 25 on tubing 36 until it reaches its desired location in the well. Tubing 36 defines a central passage 37 therethrough. The desired location will have been determined prior to lowering landing sub 34 into well 25, and will be located such that parameters can be sensed at desired locations in well 25. Well 25 comprises a vertical section 38 and lateral section 40. Landing sub 34 is positioned in lateral section 40 and pump down tool 32 is pumped through tubing 36 in vertical section 38 and into lateral section 40 until it engages landing sub 34. The fiber optic cable will be passed through injector head 20 and will be connected to pump down tool 32 which will then be injected into well 25 through well head 22. Prior to pumping the pump down tool 32 into well 25, a plug connected at the bottom end of landing sub 34 will be removed therefrom with fluid pressure. Fiber optic pump down tool 32 will be pumped into the well using fluid pressure in well 25. Injector head 20 will assist in moving the fiber optic cable into well 25 but will be utilized simply to ensure that the tension on the fiber optic cable is not such that the cable will snap or break. Pumping will continue until pump down tool 32 engages landing sub 34.

Referring now to FIGS. 2-8, landing sub 34 may be comprised of a plurality of jointed pipe sections 42 with a seating nipple 44 connected therein. Landing profile or seat 43 is defined in seating nipple 44 and will be engaged by pump down tool 32 when the tool reaches the predetermined, desired location in well 25. Landing sub 34 has a central passage 48 defined by first diameter 50, second diameter 52 which is the largest inner diameter, and a third or intermediate internal diameter 54. A plug 56 is attached to a lower end of landing sub 34. When landing sub 34 reaches the desired location in well 25 a pressure increase inside the tubing will disconnect the plug 56 from landing sub 34 and will allow fluid flow upwardly through central passage 48. A capillary tube, which may be a fiber optic cable 58 is fixed to pump down tool 32. Fiber optic cable 58 may be of a type known in the art and may be a single or multiple mode fiber optic cable. As is known in the art, fiber optic cable 58 comprises outer protective coatings to protect the fibers therein.

Pump down tool 32 may comprise a mandrel 60 which may also be referred to as a capillary, or fiber optic cable housing 60. Mandrel 60 has a passageway 59 therethrough and an outer diameter 61. A fishing neck 62 is connected to an upper end 63 of mandrel 60 so that pump down tool 32 may be retrieved from well 25. Mandrel 60 may comprise an upper lock housing 64 connected to an upper gauge housing 66. A mandrel connector 68 connects upper gauge housing 66 to a swab cup or swab element mandrel 70. A plurality of swab cups or swab elements 72 are disposed about swab cup mandrel 70. Swab cups 72 have an outer diameter 74. Outer diameter 74 is larger than outer diameter 61, so that swab cups 72 extend radially outward from housing 60.

A seating cup 76, or seating plug 76 is connected to swab cup mandrel 70. Seating cup 76 comprises a seating cup mandrel 78 with a plurality of seating elements 80 disposed thereabout and a cup head or seating head 82 for engaging landing profile 43 in landing sub 34. A stack cup, or flex cup mandrel 84 is connected to seating cup 76. Stack cup mandrel 84 has a plurality of flex cups 86 disposed thereabout. Flex cups 86 have an outer diameter 87 that is larger than outer diameter 74 of swab cups 72. As such, flex cups 86 extend radially outwardly from housing 60. A lower lock housing 88 is connected to flex cup mandrel 84 and a lower gauge housing 90 is connected to lower lock housing 88. A bull plug 92 is connected to lower gauge housing 90.

Figure 2:
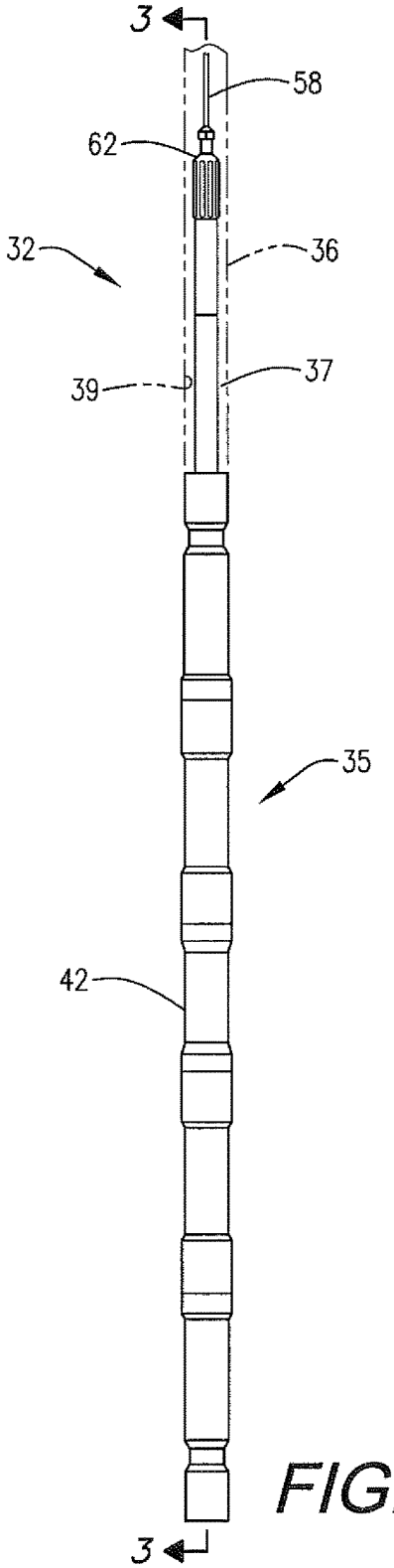
FIG. 2 is an elevation view of a pump down assembly of the capillary delivery system.
Figure 3:
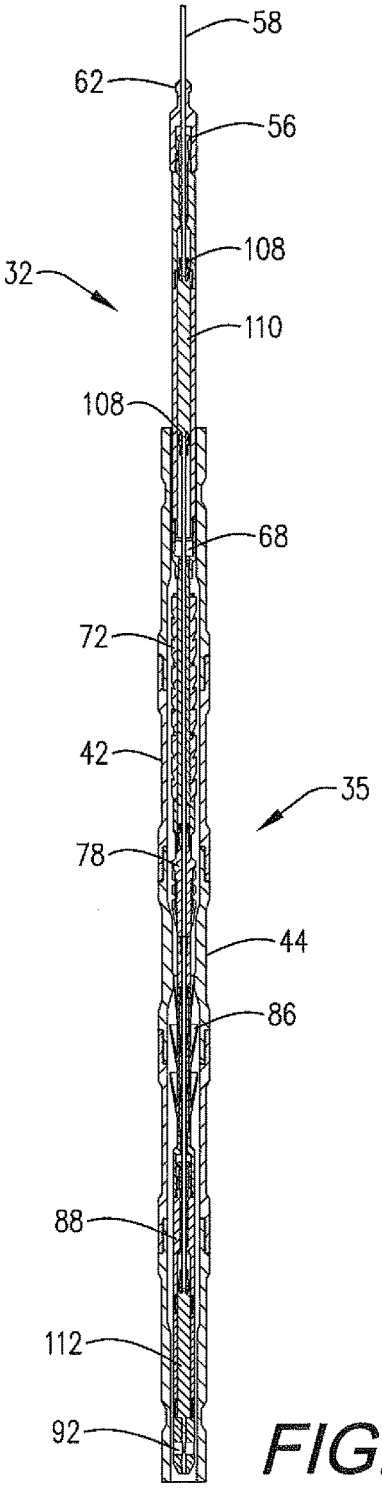
FIG. 3 is a section view from line 3-3 of FIG. 2.
Figure 4A:
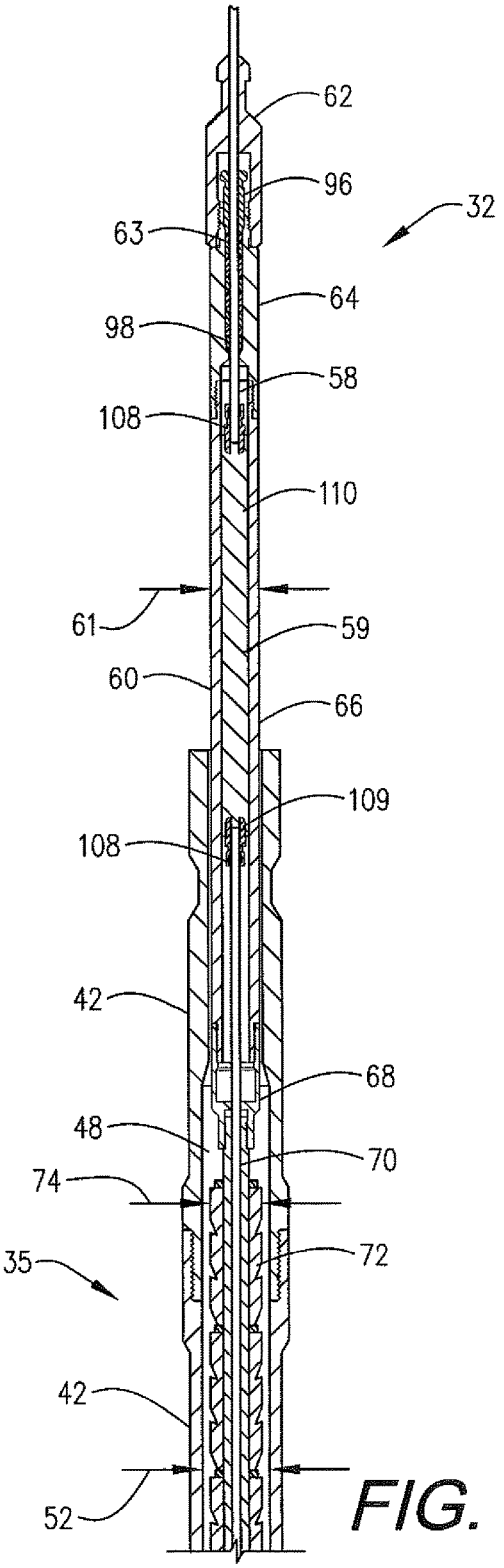
FIGS. 4A-4B show a section view of a pump down tool seated in a landing sub.
Figure 4B:
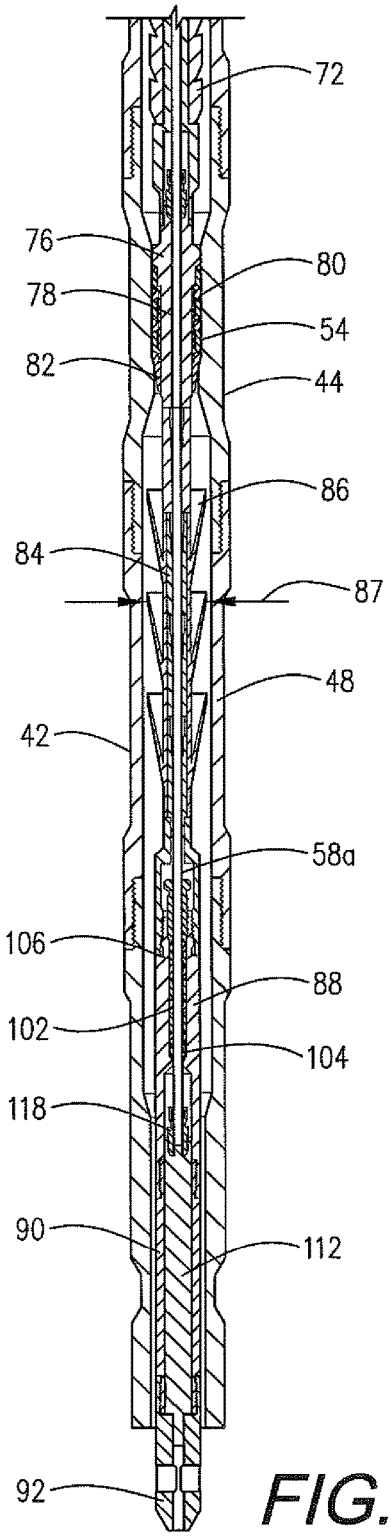
Figure 5:
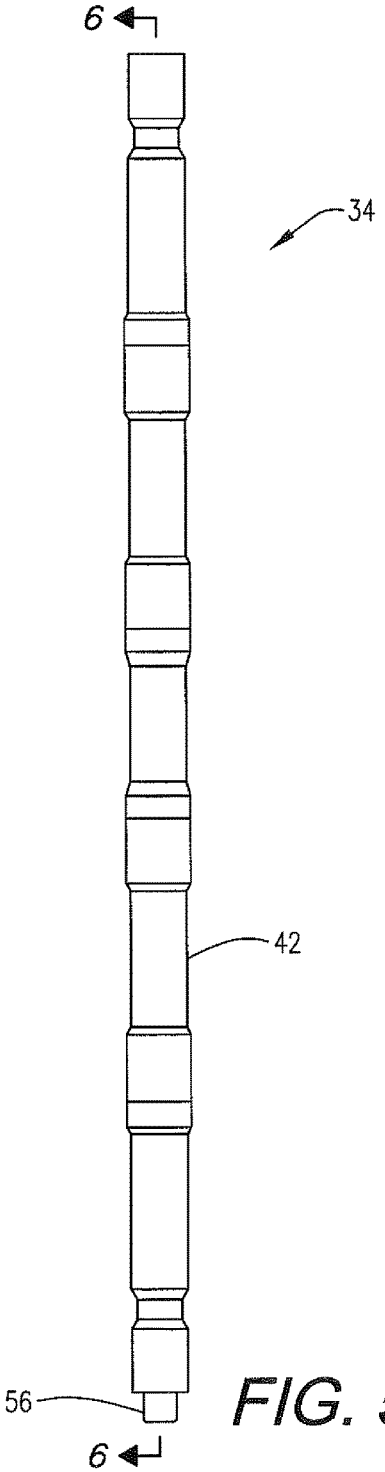
FIG. 5 is an elevation view of a landing sub.
Figure 6:
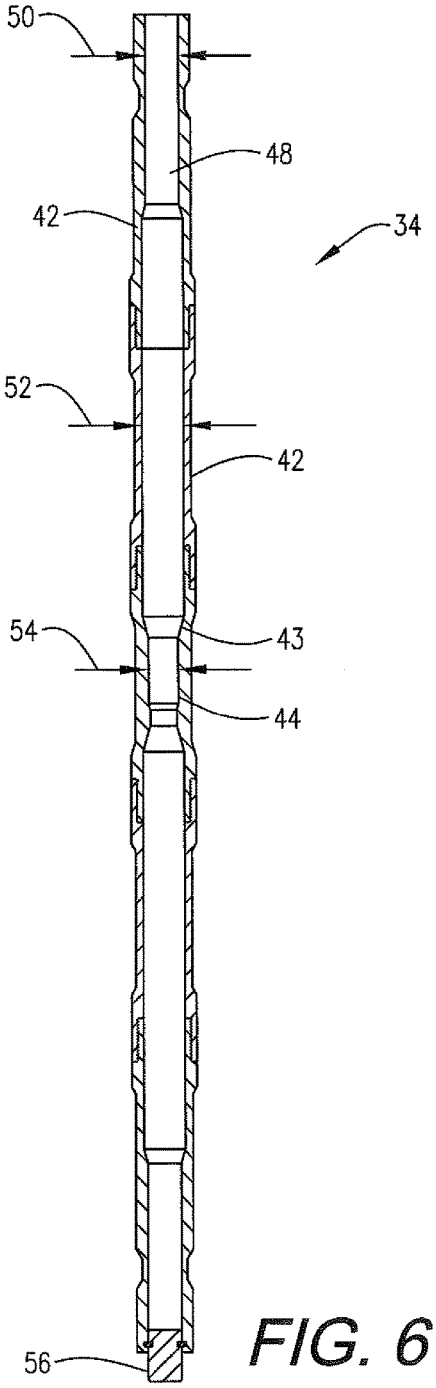
FIG. 6 is a section view from line 6-6 of FIG. 5.
Figure 7:
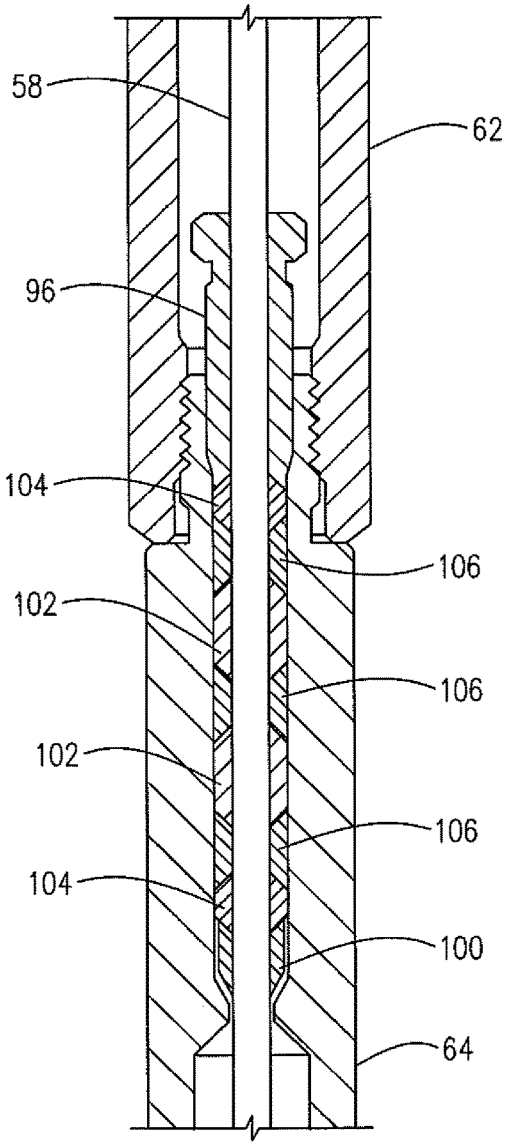
FIG. 7 is an enlarged view showing the details of an assembly that services the capillary to the pump down tool.
Figure 8:
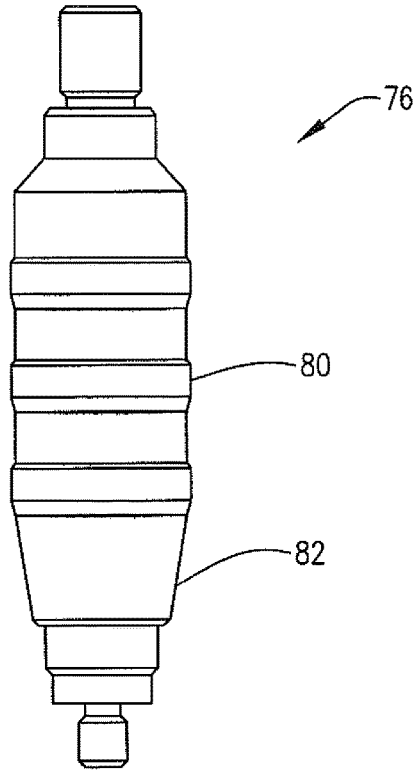
FIG. 8 is a view of the seating cup of the pump down tool.

Fiber optic cable 58 extends into housing 60 and is fixed therein so that the movement of housing 60 will pull fiber optic cable through well 25 to the desired location in the lateral section 40 of well 25. Fiber optic line 58 may be fixed to housing 60 in any manner known in the art but may be for example fixed utilizing retainers and compression type fittings. As shown in FIG. 2, a lock nut 96 may be threaded into an upper end of upper lock housing 64. Upper lock housing 64 may include a ferrule 98 positioned in a recessed diameter section thereof. A plurality of retainers such as retainers 104, which may be friction retainers for frictionally engaging fiber optic cable 58, along with a plurality of friction retainers 106 which will frictionally engage the inner diameter of gauge housing 66 are used to fix fiber optic cable 58 to housing 60. Additional retainers 102, which may be for example silicon spacers may be positioned about fiber optic cable 58. When lock nut 96 is threaded into upper lock housing 64 the retainers 102, 104 and 106 will be compressed due to the action of ferrule 98 and will hold fiber optic cable 58 in place. Fiber optic cable 58 may extend in passageway 59 of housing 60 and may be connected with a fitting 108 of the type known in the art, which may be a ferrule or compression type fitting, to an upper fiber optic gauge or sensor 110. Fiber optic cable 58 may be spliced to gauge 110 in any manner known in the art.

A second fiber optic cable **58*a* may be connected at a lower end 109 of the upper gauge 110 by a similar fitting 108 and may extend through swab cup mandrel 70, seating cup mandrel 78 and flex cup mandrel 84. Fiber optic cable 58*a* is connected to a lower gauge 112 and is spliced thereto. The arrangement of retainers in lower gauge housing 90 is similar to that set forth with respect to the upper gauge housing 64 so that lower fiber optic cable 58*a* fixed to housing 60**.

Landing sub 34 is lowered into well 25 on tubing string 36. Landing sub 34 is snubbed into the well through well head 22 in a manner known in the art. Landing sub 34 will be lowered into the well in a manner known in the art until it reaches a predetermined desired position in the well. Landing sub 34 will be located such that when pump down tool 32 engages landing profile 43, gauges 110 and 112 will be positioned as desired in the well. It is understood that fiber optic cables 58 and **58*a* may also sense well parameters. Fiber optic cables 58 and 58*a* may for example sense parameters on a one meter spacing in well 25 and in particular in lateral section 40. Thus, while the embodiment described uses sensors, or gauges 110 and 112 system 10 may be used with or without gauges. Once landing sub 34 reaches proper depth, pressure is increased in tubing 36 to detach the plug 56 on the lower end thereof. Fluid from well 25 can then enter central passage 37. Pump down tool 32 is assembled, and connected to fiber optic cable 58 after cable 58 is passed through injector head 20**.

The operation of system 10 may be described as follows. Fiber optic cable 58 is spooled from spooling unit 15 through injector head 20. Pump down tool 32 will be assembled from the bottom up as shown in the drawings. Fiber optic cable 58 will be attached to upper gauge 110, and upper lock housing 64 will be threaded onto upper gauge housing 66. Retainers 102, 104 and 106 will be positioned in upper gauge housing 66 as described herein and lock nut 96 will be threaded thereon. Fishing neck 62 may then be connected to upper lock housing 64.

Once pump down tool 32 is assembled and connected to fiber optic line 58, pump down tool 32 is snubbed through well head 22 and pumped into the well. Injector 20 will assist to prevent over tensioning on fiber optic cable 58. Line counters and other means (not shown) may be used to measure the length of cable delivered into the well. Preferably, outer diameter 74 of swab cups 72 will engage or nearly engage inner diameter 39 of tubing 36. Flex cups 84 will engage the inner diameter of tubing 36 as it passes therethrough. Fluid pressure applied from above will therefore pump tool 32 downwardly through well 25 and into lateral section 40 thereof. Pumping will continue until seating cup 76 engages seating nipple 44. When seating cup 76 lands, pressure in tubing 36 is increased and a vent plug in tubing 36 above gauge 110 is detached from tubing 36. Well parameters can then be determined using gauges 110 and 112 and/or fiber optic cables 58 and 58*a*. For example lower gauge 112 can sense the temperature of fluid therebelow and fluid can enter passage 37 from the well annulus between tubing 36 and well 25 so that upper sensor 110 can sense the temperature of the well fluid from the annulus that passes into landing sub 34 above seating cup 76. Signals representative of the temperatures are sent to the well surface so that the temperature of the well fluid at both locations and the temperature differential can be observed. The information can be used to determine where liquid exists in the formation intersected by well 25, so that well 25 can be treated as desired for example perforated and/or fractured. Once the information has been gathered pump down tool 32 can be removed with a wireline or other means known the art. Well 25 can then be treated as desired and produced through tubing 36.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A capillary tube pump down assembly for use in a well comprising:

a landing sub positioned at a preselected location in the well, wherein the landing sub defines a seat facing uphole in the well;

a tubing connected to the landing sub;

a housing pumpable into the landing sub, the housing defining a passageway therethrough, the housing including a seating cup having a seating head facing downhole in the well for engaging the seat of the landing sub and, when engaged, preventing downhole movement of the housing relative to the landing sub such that the housing is positioned in the well at a desired location, the housing further having a plurality of sealing elements disposed about the housing and engagable with the tubing such that fluid pumped into the tubing will interact with the sealing elements to urge the housing through the tubing and into the landing sub;

at least one gauge disposed in the passageway of the housing for sensing a parameter in the wellbore;

and a capillary tube fixed in the passageway of the housing and moveable therewith, wherein the housing will engage the landing sub when the housing is pumped through the well into the landing sub;

wherein at least a portion of the sealing elements engage an inner diameter of the landing face.

2. The pump down assembly of claim 1, wherein at least a portion of the sealing elements are upward-facing cup type seals.

3. The pump down assembly of claim 1, wherein the capillary tube comprises a fiber-optic cable fixed in the passageway defined by the housing and extending to a well surface.

4. The pump down assembly of claim 3 further comprising a second fiber optic cable positioned in the passageway and completely enclosed in the housing.

5. The pump down assembly of claim 4, wherein the at least one gauge is a fiber-optic gauge disposed in the passageway of the housing for sensing a parameter in the wellbore.

6. The pump down assembly of claim 5, wherein there are a plurality of fiber optic gauges disposed in the passageway of the mandrel for sensing selected well parameters, and wherein at least one of the gauges is positioned in the passageway of the mandrel below the seat and at least one gauge is positioned in the passageway of the mandrel above the seat and wherein the fiber optic gauges are positioned in the well at a desired location when the seating cup engages the seat of the landing profile.

7. A pump down tool for use in a well comprising:

a mandrel comprising a seating cup;

a first fiber-optic cable extending from a ground surface and fixedly attached in a passageway defined by the mandrel and movable in the well with the mandrel;

a plurality of sealing elements disposed about the mandrel, the elements extending radially outwardly from an outermost diameter of the mandrel, wherein fluid pumped into the well pushes the elements and the mandrel attached thereto downwardly to pull the first fiber-optic cable into the well;

a landing sub fixedly attached to a tubing placed in the well at a preselected location, the landing sub having a landing profile defined therein, wherein the seating cup will engage the landing profile to position the pump down tool in the well at the desired location so that the first fiber-optic cable is positioned in the passageway of the mandrel to sense parameters in the well; and a plurality of gauges disposed in the passageway of the mandrel for sensing selected well parameters, and wherein at least one of the gauges is positioned in the passageway of the mandrel below a seating nipple and at least one gauge is positioned in the passageway of the mandrel above the seating nipple.

8. The pump down assembly of claim 7, further comprising a second fiber-optic cable positioned in the passageway and completely enclosed in the housing.

9. The pump down assembly of claim 7, wherein the landing sub is positioned in a lateral section of the well.

10. A method of sensing selected parameters in a lateral section of a well comprising:

fixing a fiber-optic cable in a passageway defined by a pumpable housing having a seating cup;

placing at least two sensors in the passageway defined by the housing wherein at least a first sensor is positioned in the passageway below the seating cup and at least a second sensor is positioned in the passageway above the seating cup;

pumping the housing through a vertical section of the well into a preselected location in the lateral section of the well; and sensing a first selected parameter in the lateral section of the well with the first sensor;

sensing a second selected parameter in the lateral section of the well with the second sensor;

sending a first signal representative of the first sensed parameter to the surface with the fiber-optic cable; and sending a second signal representative of the second sensed parameter to the surface with the fiber-optic cable.

11. The method of claim 10, further comprising:

fixing a tubing to a landing sub;

lowering the landing sub to the preselected location; and pumping the housing through the tubing into the landing sub.

12. The method of claim 11 wherein the pumping step comprises pumping the housing into the landing sub until the at least two sensors are located at preselected locations in the lateral well section.

13. The method of claim 11, further comprising pumping the housing until the seating cup thereon engages the landing sub at a landing profile such that the first sensor is positioned below the landing profile and the second sensor is positioned above the landing profile, and wherein the landing sub defines the landing profile therein.

14. The method of claim 11, wherein the tubing has a plug to prevent flow therethrough as it is lowered into the well, the method further comprising removing the plug prior to the pumping step.

15. The method of claim 10, wherein the sensing step comprises sensing a parameter with the fiber-optic cable.

16. A method of pumping a capillary tube into the lateral section of a well comprising:

fixing a tubing to a landing sub, wherein the landing sub defines a seat facing uphole in the well;

lowering the landing sub to a desired location in the lateral section of the well;

fixing the capillary tube inside a pump down tool at the surface, the pump down tool including a seating cup having a seating head facing downward in the well;

placing the pump down tool in the well;

pumping the pump down tool through the tubing until the seating cup of the pump down tool engages seat of the landing sub fixed to the tubing so as to prevent further downhole movement of the pump down tool, and wherein the pump down tool extends into the landing sub;

sensing a selected parameter of the well with the capillary tube after the pump down tool has engaged the landing sub;

and sending a signal representative of the sensed parameter to the surface with the capillary tube;

wherein at least a portion of the sealing elements engage an inner diameter of the landing face.

17. The method of claim 16, wherein the capillary tube is a fiber-optic cable.

18. The method of claim 17, further comprising placing a second fiber-optic cable in the pump down tool prior to placing the pump down tool in the well, wherein the second fiber-optic cable is positioned within the landing sub when the pump down tool is engaged with the landing sub.

* * * * *